US007061376B2

(12) United States Patent
Wang et al.

(10) Patent No.: US 7,061,376 B2
(45) Date of Patent: Jun. 13, 2006

(54) SYSTEM OF NON-INTRUSIVE ACCESS CONTROL AND METHOD THEREOF

(75) Inventors: Chung-Ren Wang, Tainan (TW); Chih-Wei Yang, Rende Township, Tainan County (TW); Jiann-Tsuen Liu, Dounan Township, Yunlin County (TW)

(73) Assignee: Institute for Information Industry, Taipei (TW)

( * ) Notice: Subject to any disclaimer, the term of this patent is extended or adjusted under 35 U.S.C. 154(b) by 108 days.

(21) Appl. No.: 10/827,473

(22) Filed: Apr. 19, 2004

(65) Prior Publication Data

US 2005/0116822 A1 Jun. 2, 2005

(30) Foreign Application Priority Data

Nov. 28, 2003 (TW) ..... 92133542 A

(51) Int. Cl.
*G08B 1/08* (2006.01)

(52) U.S. Cl. ..... 340/539.13; 340/572.1; 340/5.2

(58) Field of Classification Search ..... 340/539.13, 340/825.49, 573.4, 539.11, 539.1, 572.1, 340/5.2, 5.22, 528
See application file for complete search history.

(56) References Cited

U.S. PATENT DOCUMENTS

| | | | | |
|---|---|---|---|---|
| 6,873,260 | B1 * | 3/2005 | Lancos et al. | 340/573.1 |
| 6,915,135 | B1 * | 7/2005 | McKee et al. | 455/456.6 |
| 2003/0197612 | A1 * | 10/2003 | Tanaka et al. | 340/572.1 |

* cited by examiner

*Primary Examiner*—Anh V. La
(74) *Attorney, Agent, or Firm*—Thomas, Kayden, Horstemeyer & Risley

(57) ABSTRACT

A non-intrusive access control method. First, identification of a tag and real-time circumstance information both related to a detection area are acquired. Next, whether the tag is permitted is determined based on circumstance identification corresponding to the detection area, the tag and the real-time circumstance information.

22 Claims, 6 Drawing Sheets

SYSTEM OF NON-INTRUSIVE ACCESS CONTROL AND METHOD THEREOF

BACKGROUND OF THE INVENTION

1. Field of the Invention

The present invention relates to a non-intrusive access control method, and in particular to a non-intrusive access control method for determining whether a tag is permitted based on circumstance identification corresponding to a detection area, the identification of the tag and real-time circumstance information.

2. Description of the Related Art

Non-intrusive access control systems typically employed a detection device, such as an infrared or radio frequency identification (RFID) sensor to track movement of objects into or out of an area, such as a room or through a gate. Access control is the task of assuring that the allowable objects are permitted to stay or move into or out of the detection area. When a disallowed object moves into or out of the detection area, the detection device identifies the object and performs corrective measure, such as triggering an alarm or directing a monitoring system to the detection area for observation by a security guard.

Recently, access control has been directed toward security management of environments where children are present, such as daycare centers, private homes, and the like, because statistically accidents have been a major cause of childhood death. Household environments are particularly susceptible to accidents as they contain numerous potential dangers such as windows, balconies, stairways, kitchens, bathroom and all the objects contained therein, and others.

Space access control systems typically employ infrared sensors or radio frequency identification (RFID) sensors at dangerous locations. In an infrared system, whenever any object enters or passes through the detection area of a sensor, the sensor detects the object and performs a related process. Infrared sensors, however, lack personnel identification capability, hence they react to every person and object.

A RFID system comprises a plurality of tags and RFID readers each used for detecting a certain area. In a conventional RFID system, when a person provided with a tag enters a detection area, the RFID reader reads the identification of the tag and determines whether the person is permitted to enter the area. Each person is assigned a role, the definition of which is stored in the RFID tag. The person's role is identified based on the identification recorded in the provided RFID tag when a user thereof enters a detection area. Then RFID system determines whether that person is allowed according to access control policies.

With role-based access control policies, children may be forbidden to enter a predetermined place such as a detection area, for example. In practice, however, when parents accompany children, the children may be allowed to enter the detection area. Hence, different role-based access control policies may be required for the same detection area under different conditions, and factors such as time, personnel and others which are not included in conventional RFID systems must be considered.

Consequently, conventional RFID systems are not sufficiently flexible as the policies thereof do not include control over dynamic and real time factors of the detection area.

Hence, there is a need for a non-intrusive access control system and method to solve the above described problem of inflexibility in conventional RFID systems.

SUMMARY OF THE INVENTION

Accordingly, an object of the invention is to provide a non-intrusive access control system and method to solve the above described problem of inflexibility in conventional RFID systems.

The present invention provides a non-intrusive access control method. First, tag identification and real-time circumstance information both related to a detection area are acquired. Whether the tag is permitted is determined based on circumstance identification corresponding to the detection area, the tag identification and the real-time circumstance information.

In addition, the present invention provides a non-intrusive access control system comprising at least one tag, a sensor and a computing device coupled to the sensor. The tag stores and responds with a tag identification. The sensor detects tag identification and real-time circumstance information both related to a detection area. The computing device determines whether the tag is permitted based on circumstance identification corresponding to the detection area, the tag identification and the real-time circumstance information.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The present invention provides a non-intrusive access control system and method to solve the above described problem of inflexibility in conventional RFID systems.

Figure 1:
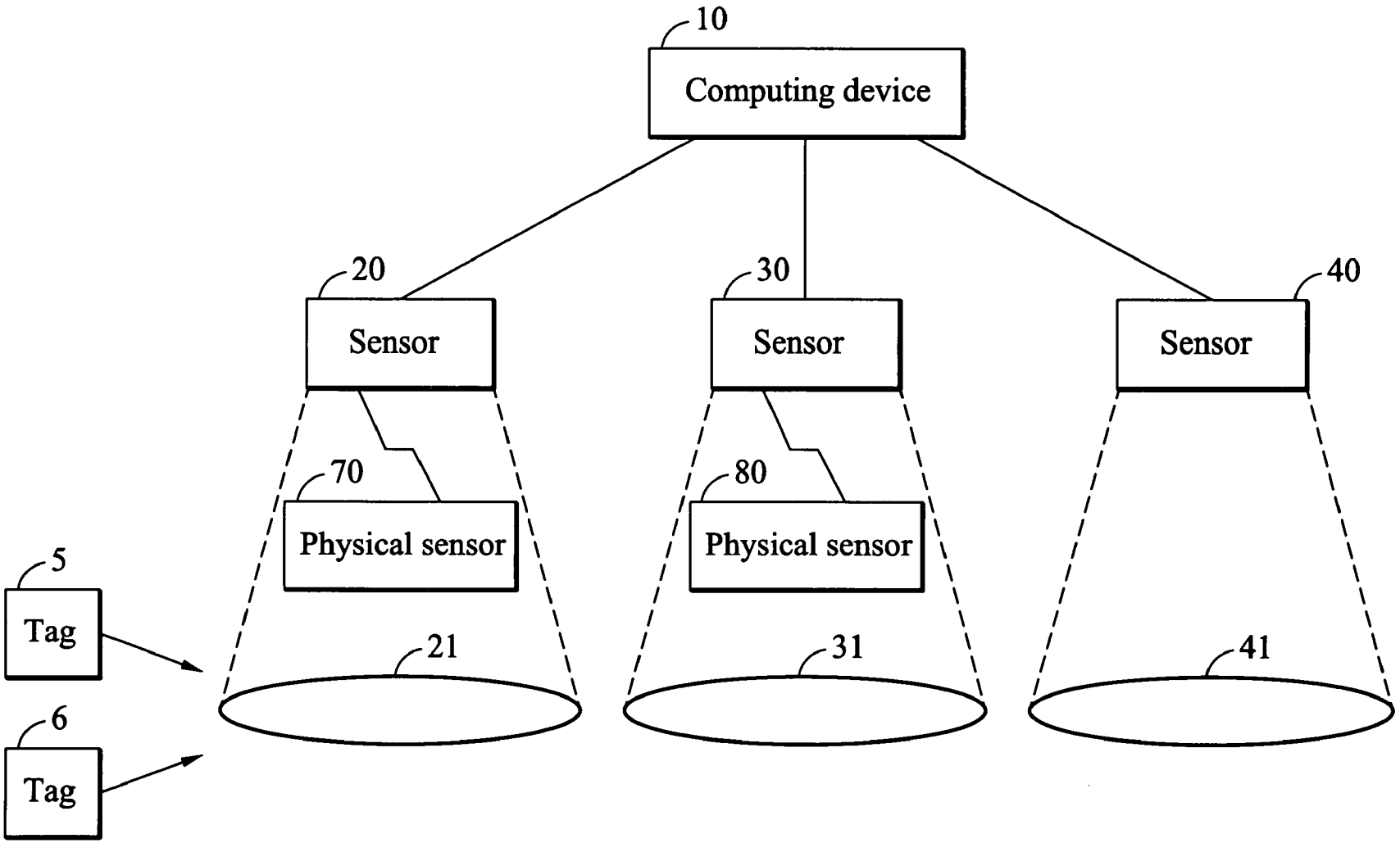
FIG. 1 is a schematic diagram of a non-intrusive access control system according to the preferred embodiment of the invention.

FIG. 1 is a schematic diagram of a non-intrusive access control system according to the preferred embodiment of the invention. The non-intrusive access control system comprises computing device 10, sensors 20–40, tags 5–6 and physical sensors 70 and 80.

Sensors 20–40 detect both real-time circumstance information and tag identification within areas 21–41 as respective detection areas. Physical sensors 70 and 80 are located in areas 21, 31 respectively. Physical sensors 70 and 80 detect certain object and obtain state information thereof as a part of the real-time circumstance information and then return it to sensors 20 and 30. In this embodiment, for example, physical sensors 70 and 80 are used for detecting the temperature of a thermos, the water-level of a bathing pool and others. Tags 5–6 store tag identification and respond to sensors with tag identification thereof. Computing device 10 couples with sensors 20–40.

In the embodiment, the non-intrusive access control system of the invention comprises an radio frequency identification (RFID) system.

Figure 2:
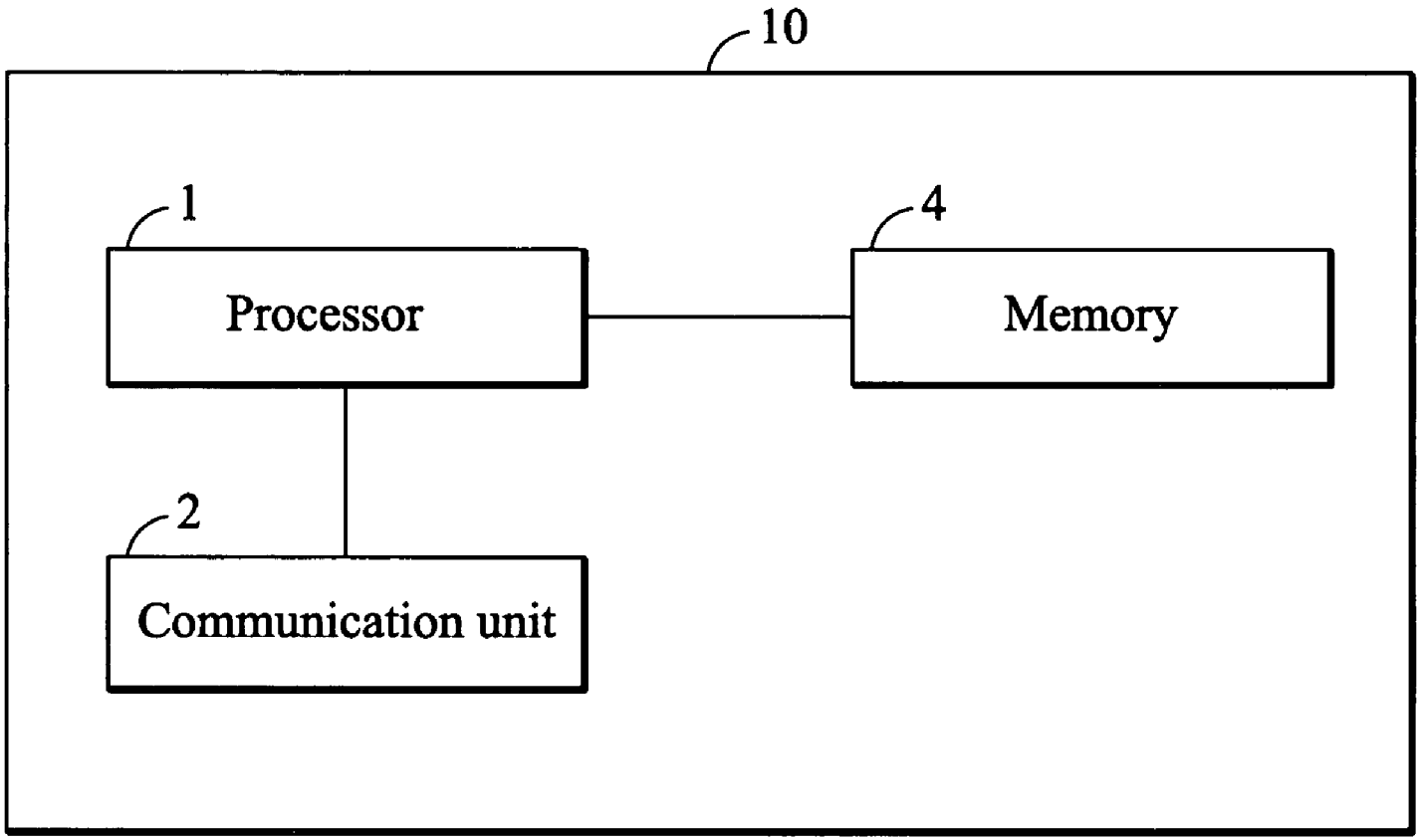
FIG. 2 is a block diagram of a computing device according to the preferred embodiment of the invention.

FIG. 2 is a block diagram of the computing device according to the preferred embodiment of the invention. Computing device 10 comprises processor 1, communication unit 2 and memory 4. Processor 1 couples to communication unit 2 and memory 4. Communication unit 2 acquires data detected and obtained by sensors 20–40.

Sensors 20–40 are located in different locations, such as a kitchen, bathroom or balcony of a house, each of which can be provided with one or more sensors. For example, a location such as a balcony can be provided with two sensors. Each sensor 20–40 has a sensor identification (or circumstance identification) corresponding to an environment role representing a corresponding detection area of the sensor.

Figure 3:
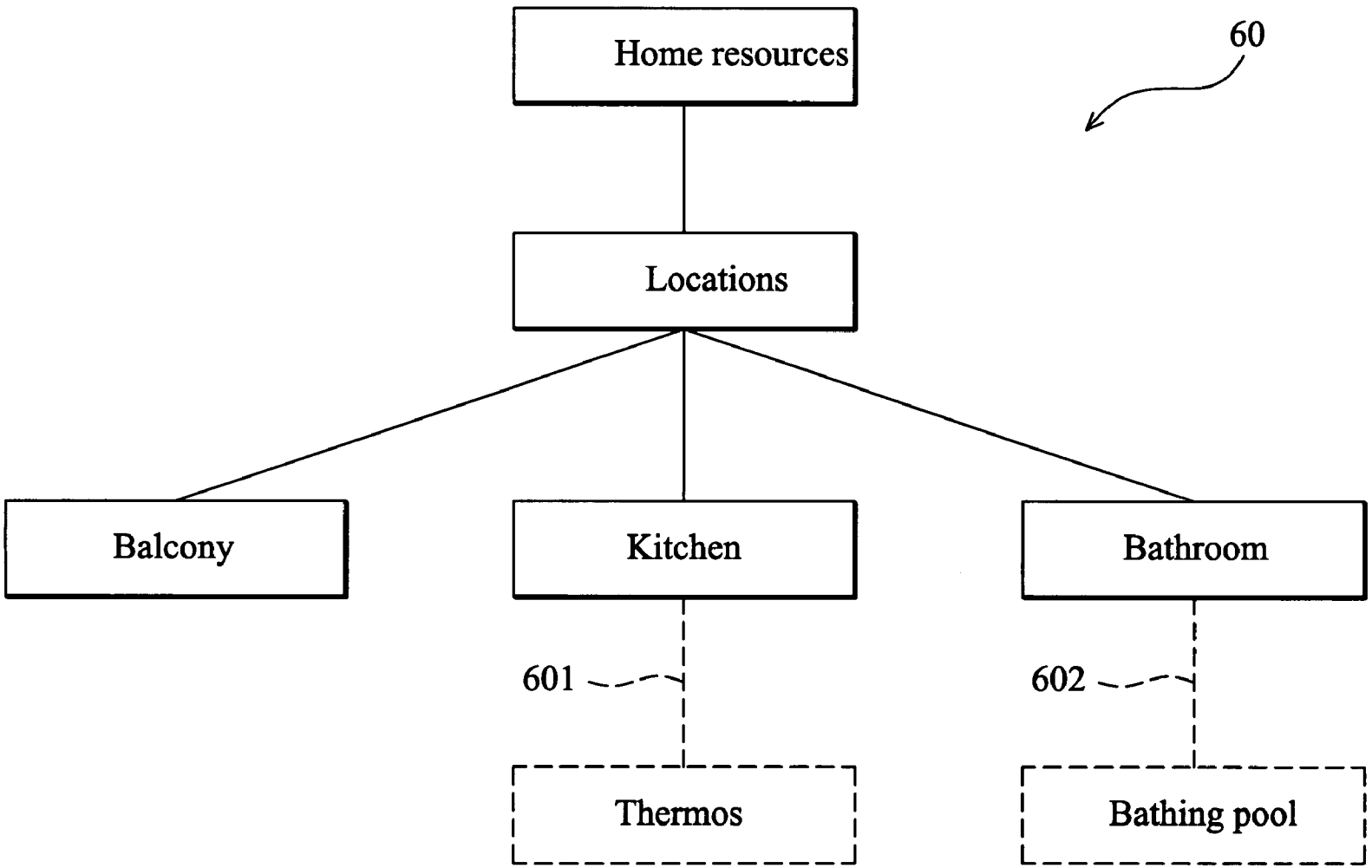
FIG. 3 is a schematic diagram of an environment role tree in the preferred embodiment of the invention.

Computing device 10 stores hierarchical relationships of environment roles and correspondence between environment roles and sensor identification of sensors 20–40 in memory 4. FIG. 3 is a schematic diagram of an environment role tree in the preferred embodiment of the invention. Environment role tree 60 represents hierarchical relationships of environment roles wherein each edge represents a hierarchical relationship and each node represents an environment role. Whenever a sensor is located, the sensor is designated an environment role using the computing device. If the designated environment role is a new-added environment role, i.e. no corresponding node thereof exists in the environment role tree 60, attributes thereof comprising indoor or outdoor, range size, location to which the designated environment role belongs and potential dangers factors must be defined. The designated environment role can be added to the environment role tree 60 by computing device 10 based on the attribute, "location to which the designated environment role belongs". For example, dotted lines 601 and 602 are new added relationships, wherein the thermos belongs to the kitchen, and the bathing pool belongs to the bathroom, as shown in FIG. 3.

Figure 4:
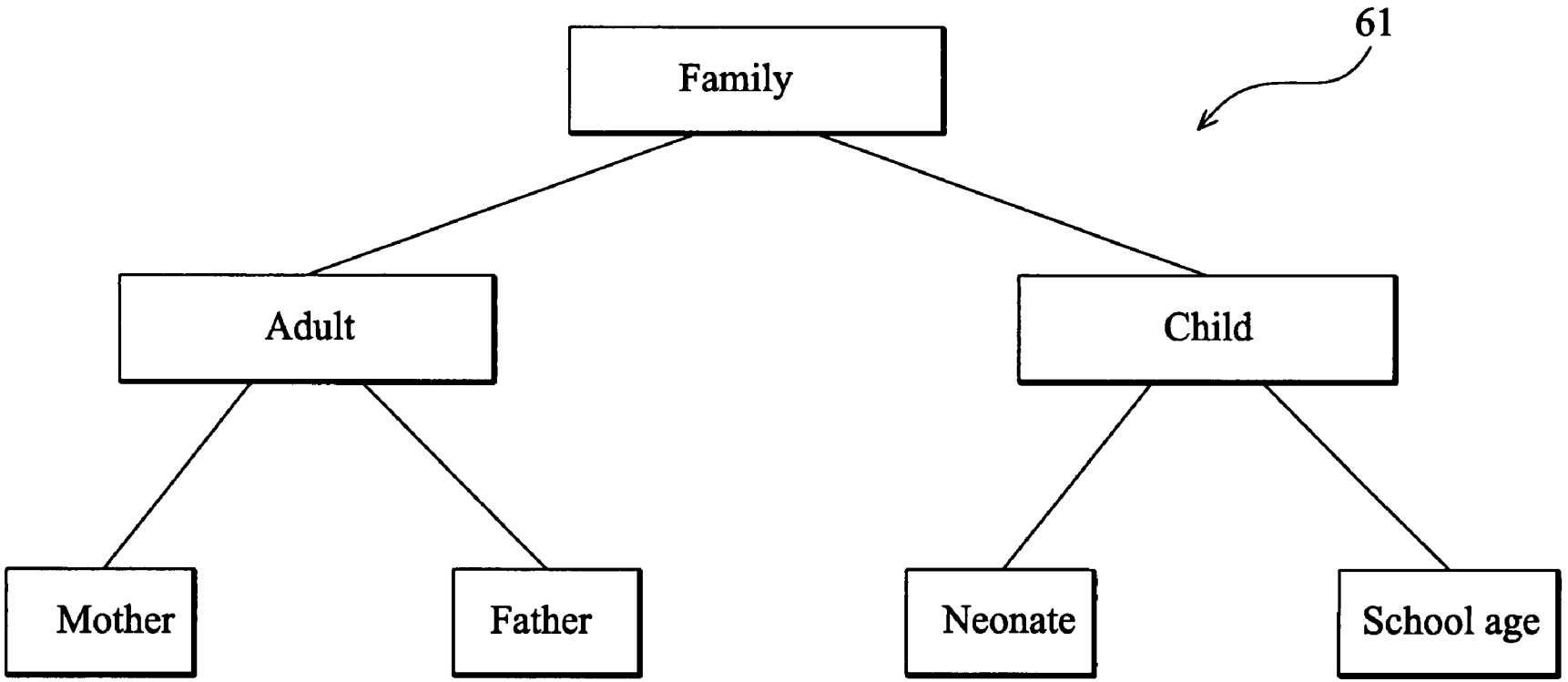
FIG. 4 is a schematic diagram of a personnel role tree in the preferred embodiment of the invention.

Each tag 5–6 stores an identification corresponding to a personnel role. Computing device 10 further stores the correspondence of the identifications of tags 5–6 to personnel roles and the hierarchical relationship of personnel roles. FIG. 4 is a schematic diagram of a personnel role tree in the preferred embodiment of the invention. Personnel role tree 61 represents the hierarchical relationships of personnel roles, wherein each edge represents a hierarchical relationship and each node represents a personnel role. In a hierarchical relationship, the personnel role of a lower node belongs to the personnel role of an upper node. Each personnel role corresponds to a rank. In the embodiment, all personnel roles correspond to two ranks, high rank and low rank. Both "Father" and "Mother", belonging to "Adult", both correspond to high degree, and "Neonate" and "School age" belonging to "Child" correspond to low rank.

In the embodiment, computing device 10 further stores circumstance information comprising three kinds of information, i.e. "personnel", "time" and "object" information, in memory 4. The personnel information comprises "with adults" and "no adults". The time information comprises "working hours", "non working hours" and "sleep hours". The object information comprises "dangerous" and "safe". It is noted that the arrangement is not intended to limit the invention.

Computing device 10 may further comprise an access control model and access control policies. Memory 4 stores the policies described in extensible markup language (XML), which comprises the fields of personnel role, environment role, environment information (or circumstance information), action and permission. Computing device 10 reads and analyzes the policies according to the access control model and determines whether the tags detected by sensors 20–40 are permitted. Although the policies in the embodiment are described in XML for program analyzability, the policies can be described in other program analyzable formats. The policies and the access control model are separate and function independently, thus the access control model does not require updating when new policies are added, deleted or altered. The access control model may be a software application or a hardware circuit.

A person provided with a tag is hereafter referred as a user. When an event occurs, such as a user entering detection area 21, for example, sensor 20 corresponding to detection area 21 detects and acquires tag identification and action "entering" of the user, and object information received from physical sensor 70. Next, sensor 20 transmits the acquired tag identification, object information, the action "entering" and sensor identification of sensor 20 to computing device 10.

Figure 5:
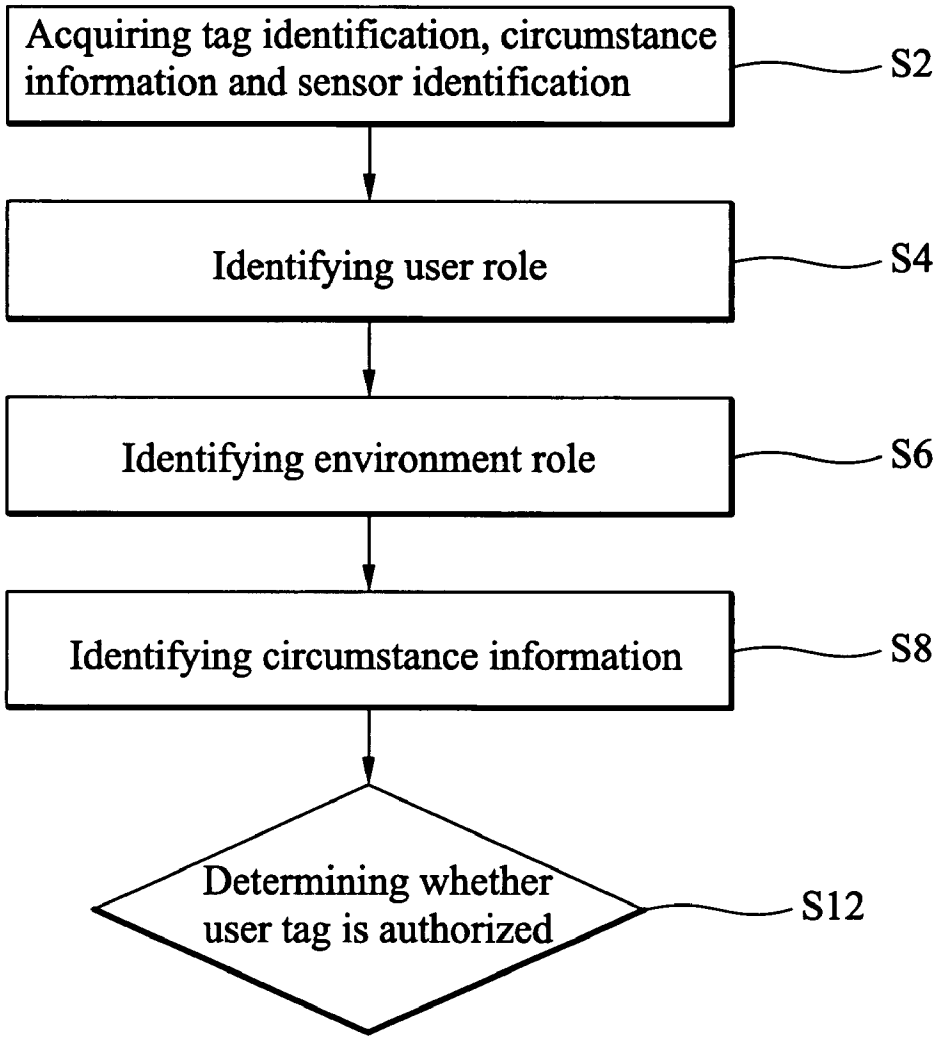
FIG. 5 is a flow chart of the non-intrusive access control method according to the preferred embodiment of the invention.

FIG. 5 is a flow chart of the non-intrusive access control method according to the preferred embodiment of the invention. In the aspect of computing device 10, processor 1 acquires the tag identification, circumstance information, the action "entering" and sensor identification of sensor 20 through communication unit 2 (step S2). Processor 1 identifies the personnel role of the user based on the tag identification (step S4), identifies the environment role of the detection area of sensor 20 based on the sensor identification (step S6), identifies environment information (step S8) and determines whether the event comprises identified personnel role, action, the identified environment role and circumstance information is permitted (step S12).

For example, in a first event, wherein a child provided with a tag enters a kitchen where a parent and a thermos therein with boiling water are present at 10:00 A.M., processor 1 identifies personnel role as "Child" and environment role as "Kitchen". In the identification process of circumstance information, processor 1 acquires original circumstance information, "Mother+10:00 A.M.+boiling water", and then identifies "Mother" as "Adult", "10:00 A.M." as "working hours" and "boiling water" as "dangerous".

Figure 6:
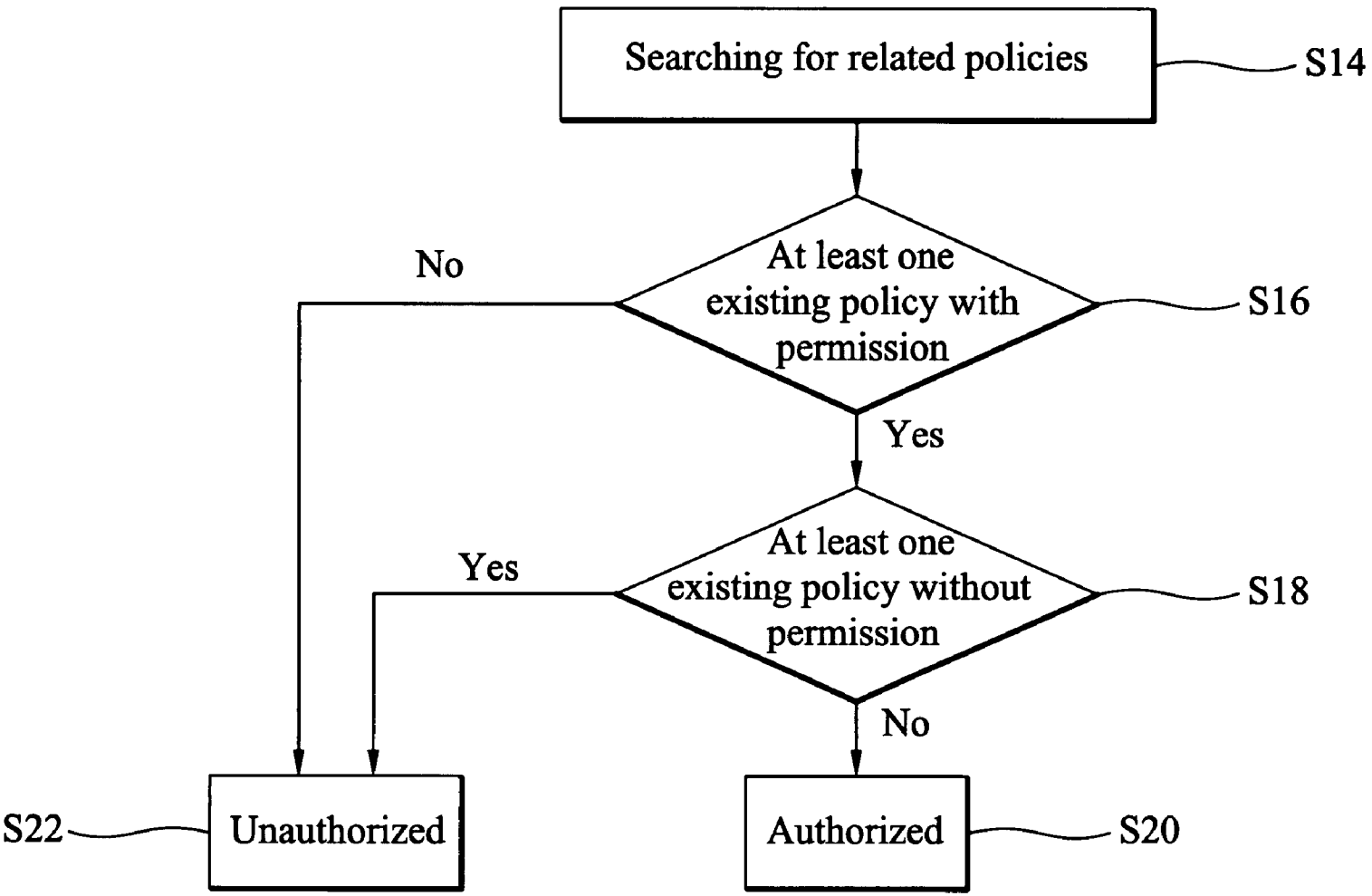
FIG. 6 is a flow chart of a permission determination process in the non-intrusive access control method according to the preferred embodiment of the invention.

FIG. 6 is a flow chart of the permission determination process in the non-intrusive access control method according to the preferred embodiment of the invention. In the determination process, processor 1 first searches for policies related to the occurred event in memory 4 (step S14). The related policies are policies wherein personnel role and environment role thereof respectively belong to personnel role and environment role acquired by computing device 10, environment information thereof belongs or relates to the environment information acquired by computing device 10, and action information thereof relates to the action information acquired by computing device 10.

In the embodiment, environment information of located related policies belongs to the environment information identified by computing device 10. For example, in the case of the first event, processor 1 searches for policies wherein personnel role in the field thereof belongs to "child", environment role thereof belongs to "Kitchen", personnel information thereof belongs to "with adult", time information thereof belongs to "working hours", object information thereof belongs to "dangerous" and action information thereof relates to "entering".

When finished searching for a related policy, processor 1 determines whether there is any related policy with permission field, "allow". If not, processor 1 then determines the event is not permitted, i.e. the tag of the user is not permitted (step S22). If at least a policy with permission field "allow" exists, processor 1 determines whether any related policy with permission field "deny" exists (step S18). If a related policy with permission field "deny" exists, processor 1 then determines the tag is not permitted (step S22). If there is no related policy with permission field "deny" and at least a policy with permission field "allow" exists, processor 1 then determines the tag is permitted (step S20).

In the embodiment, for example, there is a policy for implementing a rule, wherein a tag of a child entering a kitchen in which a parent or a person with high rank is present is permitted. The policy may comprise the following information, "Child", "Kitchen", "with adult", "entering or staying" and "allow". There is another policy for implementing the following rule, wherein a tag of a child is not permitted in a kitchen with a dangerous object therein. The policy may comprise the following information, "Child", "Kitchen", "dangerous", "entering or staying" and "deny". When the first event occurs, processor 1 will locate these two policies in the permission determination process, of which the former is an "allow" policy and the latter is a "deny" policy. Hence, processor 1 determines the tag of the child is not permitted in the first event.

Events triggering permission determination process may comprise user action (e.g. entering or leaving), object status (e.g. boiling water in thermos, high water-level in bathing pool), and time factor (e.g. a user staying in a location exceeding a predetermined time). When a plurality of users enters a detection area, the user with the highest rank may be adapted to represent the users, i.e. processor 1 may determine whether the user is permitted to enter the detection area based on the personnel role of the tag with the highest rank.

In the non-intrusive access control system and method according to the preferred embodiment, the objective of the arrangement wherein the environment information comprises "personnel", "time", and "object" information is to enhance effectiveness and flexibility of access control. The environment information may comprise other information in addition to "personnel", "time", and "object" information or only one set of information. The "personnel" information may comprise other information for a user or object provided with tag.

The non-intrusive access control method of the invention may be used for other fields. For example, when used for traffic control, the non-intrusive access control method of the invention enhances the effectiveness and flexibility of a traffic light. A car may be provided with a tag, for example, on a license plate. Sensors are set near traffic lights. A computing device determines the traffic condition near a traffic light based on tag identification of cars and environment information comprising number, waiting time and priority of cars and time factors. Hence, the effectiveness and flexibility of a traffic light and traffic control can be enhanced.

In conclusion, the non-intrusive access control method and non-intrusive access control system of the invention solve the above described problem of inflexibility in conventional RFID systems.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A non-intrusive access control method, comprising the steps of:

acquiring identification of tags existing in a detection area;

determining user roles represented by the tags based on the acquired identification thereof, wherein each user role has been assigned a rank;

retrieving identification of a first tag corresponding to a user role with the highest rank;

acquiring real-time circumstance information related to the detection area; and determining whether the tags are permitted based on circumstance identification corresponding to the detection area, the identification of the first tag, and the real-time circumstance information.

2. The method as claimed in claim 1, wherein the real-time circumstance information comprises user information indicating existence of any other tag in the detection area.

3. The method as claimed in claim 1, wherein the real-time circumstance information comprises time information comprising at least current time or total time.

4. The method as claimed in claim 1, wherein the real-time circumstance information comprises physical information indicating status of an object.

5. The method as claimed in claim 4, further comprising:

detecting whether water in a thermos is boiling; and when the circumstance information indicating that the water in the thermos has been boiling, determining that one of the tags corresponding to a low rank is not permitted to stay in the detection area.

6. The method as claimed in claim 4, further comprising detecting water level in a bathing pool as the circumstance information.

7. The method as claimed in claim 1, wherein the first tag is not permitted to stay in the detection area, further comprising determining that the first tag is permitted under a condition where a tag corresponding to a user role with higher rank than the user role of the first tag exist and is permitted to stay in the detection area.

8. The method as claimed in claim 1, wherein the corresponding circumstance identification of the detection area corresponds to a circumstance role, as one of a plurality of circumstance roles with hierarchical relationship, each comprising at least one circumstance attribute.

9. The method as claimed in claim 8, further comprising defining the hierarchical relationship based on the circumstance attribute.

10. The method as claimed in claim 1, wherein the determining step is based on one or more policies each recording the relationship of user role, circumstance role, real-time circumstance information and permission.

11. The method as claimed in claim 10, wherein the policies is presented in extensible markup language (XML) format.

12. The method as claimed in claim 10, further comprising the steps of:

searching for policies related to the circumstance identification corresponding to the detection area, the identification of the first tag and the real-time circumstance information;

determining the first tag is not permitted when no policy allowing permission is located; and determining the first tag is permitted when at least one related policy with permission and no related policy denying permission is located.

13. An non-intrusive access control system, comprising:

a sensor for acquiring identification of tags and real-time circumstance information from a detection area; and a computing device for determining user roles represented by the tags based on the acquired identification thereof, wherein each user role has been assigned a rank, and the computing device retrieves identification of a first tag corresponding to a user role with the highest rank and determines whether the tags are permitted based on circumstance identification corresponding to the detection area, the identification of the first tag, and real-time circumstance information.

14. The system as claimed in claim 13, wherein the real-time circumstance information comprises user information indicating whether another tag exists in the detection area.

15. The system as claimed in claim 13, wherein the real-time circumstance information comprises time information comprising at least current time or total time.

16. The system as claimed in claim 13, wherein the real-time circumstance information comprises physical information indicating status of an object.

17. The system as claimed in claim 16, further comprising a physical sensor detecting whether water in a thermos is boiling, wherein when the circumstance information indicating that the water in the thermos has been boiling, determining that one of the tags corresponding to a low rank is not permitted to stay in the detection area.

18. The system as claimed in claim 16, further comprising a physical sensor detecting water level in a bathing pool as the circumstance information.

19. The system as claimed in claim 13, wherein the first tag is not permitted to stay in the detection area, and the computing device further determines that the first tag is permitted under a condition where a tag corresponding to a user role with higher rank than the user role of the first tag exist and is permitted to stay in the detection area.

20. The system as claimed in claim 13, wherein the computing device performs the determination step based on one or more policies each comprising the relationship of user role, circumstance role, real-time circumstance information and permission.

21. The system as claimed in claim 20, wherein the computing device further searches for policies related to the circumstance identification corresponding to the detection area, the identification of the first tag and the real-time circumstance information, and determines the first tag is not permitted when no related policy allowing access is located or determines the first tag is permitted when at least one policy with permission and no related policy denying access is located.

22. The system as claimed in claim 15, wherein the non-intrusive access control system comprises a radio frequency identification (RFID) system.

* * * * *